US005542134A

United States Patent [19]

Wang

[11] Patent Number: 5,542,134

[45] Date of Patent: Aug. 6, 1996

[54] CONTROL DEVICE FOR FOLDING AND EXPANDING A BASE PORTION OF A PLAYPEN

[76] Inventor: Kun Wang, No. 51, Lane 31, Sec. 2, Changping Rd., Taichung, Taiwan

[21] Appl. No.: 403,668

[22] Filed: Mar. 14, 1995

[51] Int. Cl.[6] ..... A47D 7/00

[52] U.S. Cl. ..... 5/99.1

[58] Field of Search ..... 5/93.1, 98.1, 99.1

[56] References Cited

U.S. PATENT DOCUMENTS

| | | | |
|---|---|---|---|
| 5,279,006 | 1/1994 | Teng | 5/98.1 |
| 5,353,451 | 10/1994 | Hsiung | 5/99.1 |
| 5,446,931 | 9/1995 | Wei | 5/98.1 |

*Primary Examiner*—Flemming Saether
*Attorney, Agent, or Firm*—Hedman, Gibson & Costigan, P.C.

[57] ABSTRACT

A control device is provided for folding and expanding a base portion of a playpen which includes four vertical stands respectively mounted on four corners thereof and a base portion mounted on an underside thereof, four foot portions each fixedly mounted on a bottom end of a corresponding one of the vertical stands, four drive posts each having a first end pivotally engaged with a corresponding one of the four foot portions and having a second end pivotally connected to the base portion, and a flexible casing enclosed around a peripheral portion of the playpen and having an underside engaged with the base portion. The control device includes four block members each fixed on the base portion and pivotally engaged with the second end of a corresponding one of the drive posts, two transmission assemblies each mounted between two of the four drive posts and opposite to each other, each of the transmission assemblies including a bracket member mounted in a mediate portion of the transmission assembly, and a pair of linking rods each having a first end pivotally engaged with a corresponding one of the foot portions and having a second end pivotally engaged with the bracket member, four fastener members each mounted on the first end of a corresponding one of the linking rods and each pivotally engaged with the first end of a corresponding one of the drive posts.

2 Claims, 7 Drawing Sheets

CONTROL DEVICE FOR FOLDING AND EXPANDING A BASE PORTION OF A PLAYPEN

BACKGROUND OF THE INVENTION

1. Field of Invention

The present invention relates to a control device, and more particularly to a control device for folding and expanding a base portion of a playpen.

2. Related Prior Art

A conventional control device for folding and expanding a base portion of a playpen is complex in structure and At is not easy to perform the operation of folding and expanding the playpen.

The present invention has arisen to mitigate and/or obviate the disadvantages of the conventional playpen.

SUMMARY OF THE INVENTION

In accordance with one aspect of the present invention, there is provided a control device for folding and expanding a base portion of a playpen which comprises four vertical stands respectively mounted on four corners thereof and a base portion mounted on an underside thereof, four foot portions each fixedly mounted on a bottom end of a corresponding one of the vertical stands, four drive posts each having a first end pivotally engaged with a corresponding one of the four foot portions and having a second end pivotally connected to the base portion, and a flexible casing enclosed around a peripheral portion of the playpen and having an underside engaged with the base portion.

The control device comprises four block members each fixed on the base portion and pivotally engaged with the second end of a corresponding one of the drive posts, two transmission assemblies each mounted between two of the four drive posts and opposite to each other, each of the transmission assemblies comprising a bracket member mounted in a mediate portion of the transmission assembly, and a pair of linking rods each having a first end pivotally engaged with a corresponding one of the foot portions and having a second end pivotally engaged with the bracket member, four fastener members each mounted on the first end of a corresponding one of the linking rods and each pivotally engaged with the first end of a corresponding one of the drive posts.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
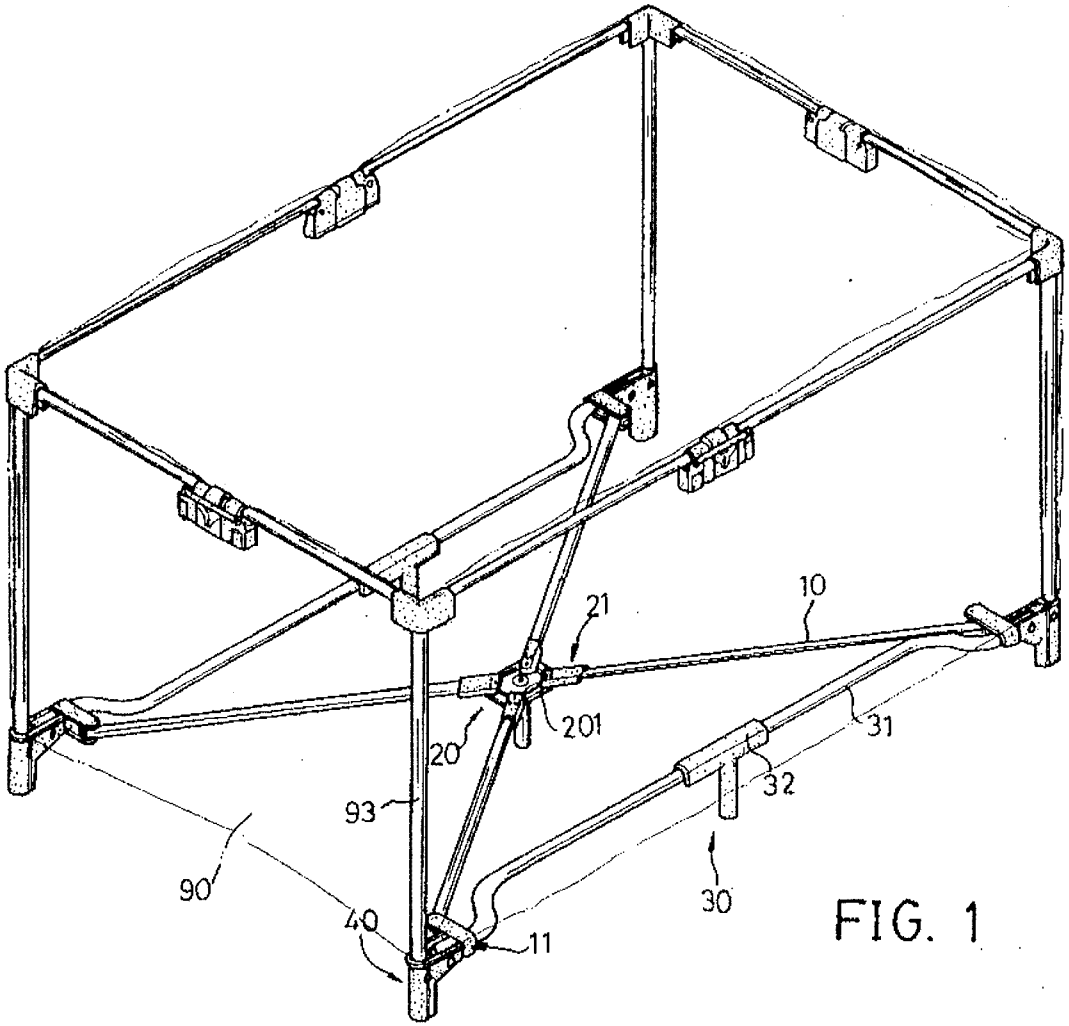
FIG. 1 is a perspective view of a playpen in accordance with the present invention.
Figure 2:
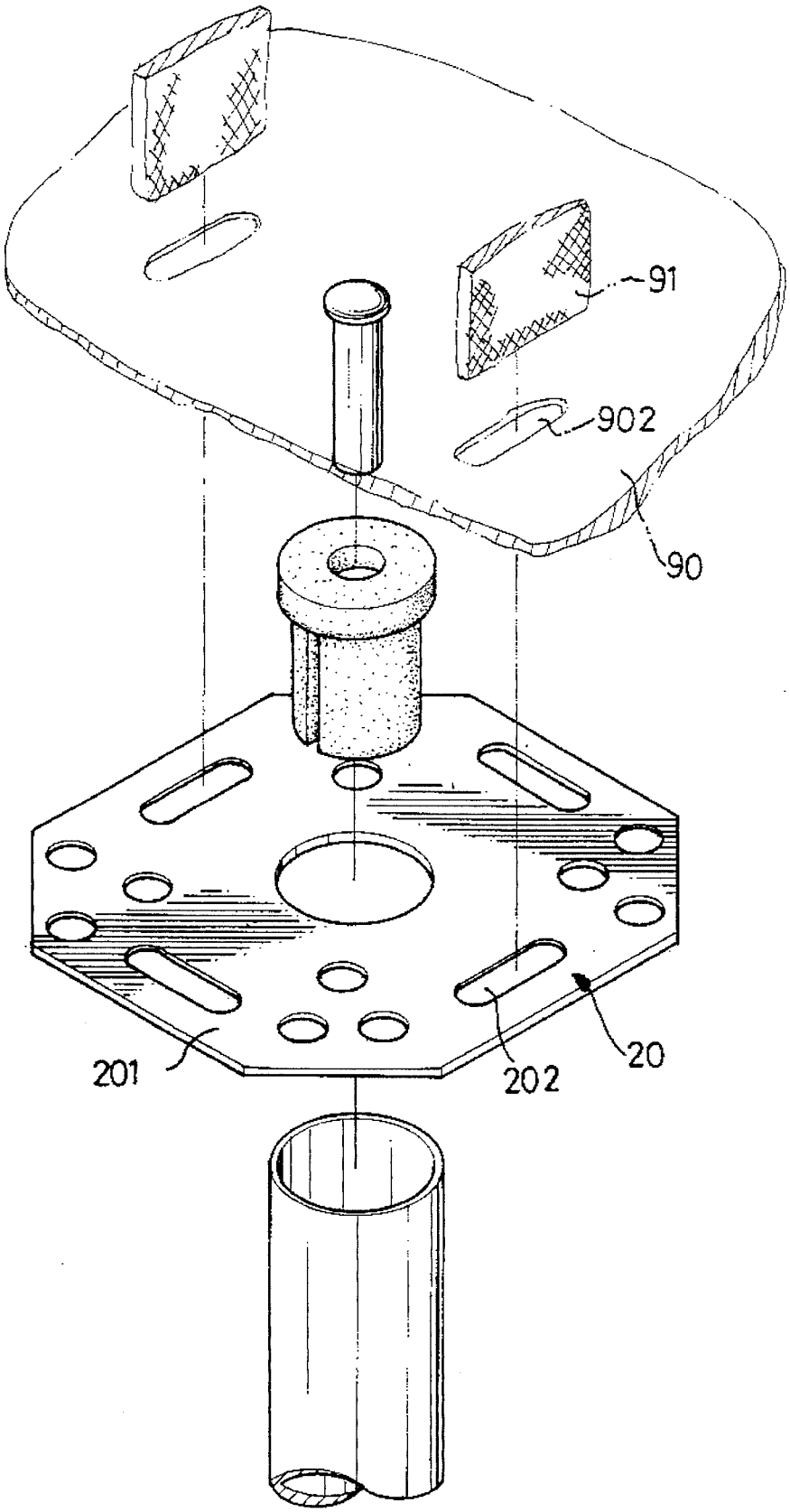
FIG. 2 is an exploded view showing a base portion engaging with a flexible casing.

Referring to the drawings, and initially to FIGS. 1 and 2, a control device in accordance with the present invention is provided for folding and expanding a base portion 20 of a playpen which comprises four vertical stands 93 respectively mounted on four corners thereof and a base portion 20 mounted on an underside thereof, four foot portions 40 each fixedly mounted on a bottom end of a corresponding one of the vertical stands 93, four drive poets 10 each having a first end pivotally engaged with a corresponding one of the four foot portions 40 and having a second end pivotally connected to the base portion 20, and a flexible casing 90 enclosed around a peripheral portion of the playpen and having an underside engaged with the base portion 20. Preferably, the base portion 20 includes a top plate 201 in which at least two and preferably four holes 202 are defined therethrough. An elongated strip 91 is mounted on the flexible casing 90 and includes two free ends each extending through a hole 902 defined in the flexible casing 90 and retained in an associated hole 202 defined in the top plate 201 of the base portion 20.

The control device comprises four block members 21 each fixed on the base portion 20 and pivotally engaged with the second end of a corresponding one of the drive posts 10, two transmission assemblies 30 each mounted between two of the four drive posts 10 and opposite to each other, each of the transmission assemblies 30 comprising a bracket member 32 mounted in a mediate portion of the transmission assembly 30, and a pair of linking rods 31 each having a first end pivotally engaged with a corresponding one of the foot portions 40 and having a second end pivotally engaged with the bracket member 32, and four fastener members 11 each mounted on the first end of a corresponding one of the linking rods 31 and each pivotally engaged with the first end of a corresponding one of the drive posts 10. Preferably, a plurality of pins 23 respectively extend through holes 22 vertically defined in the block member 21 so as to fix the block member 21 on the top plate 201 of the base portion 20.

Figure 3:
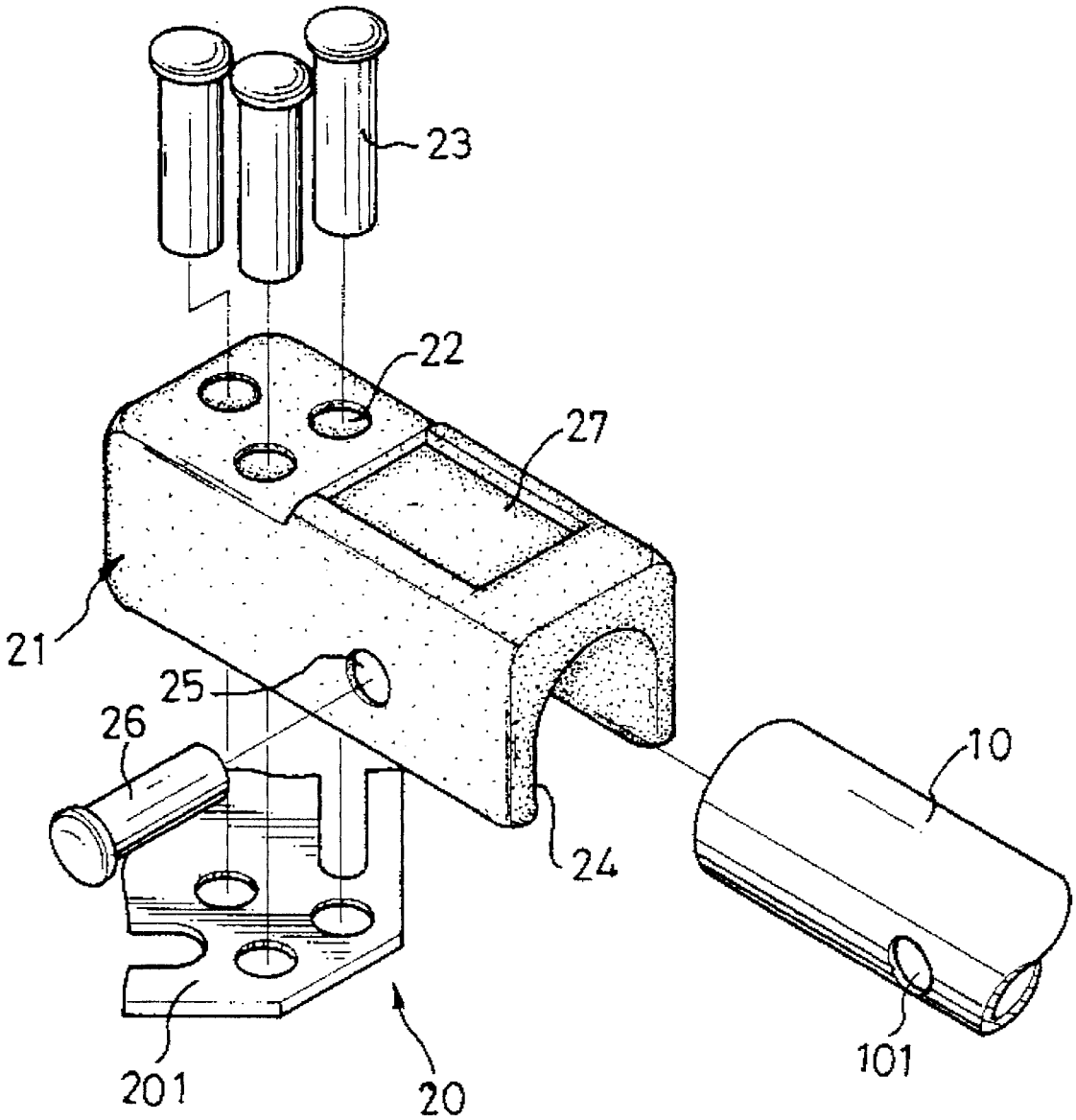
FIG. 3 is a perspective view showing how a block member engages with a drive post and a base portion.

Referring to FIG. 3, each of the block members 21 defines a longitudinal recess 24 therein having an opening facing downwardly and further defining a vertical compartment 27 therethrough which communicates with the recess 24, a pair of aligned holes 25 transversely defined through the block member 21 and communicating with the vertical compartment 27, the second end of the drive post 10 being received in the longitudinal recess 24 and defining a transverse bore 101 therethrough which aligns with the pair of holes 25, a pivot axle 26 extending through the pair of holes 25 and the bore 101 such that the second end of the drive post 10 is pivotally engaged with the block member 21 at the pivot axle 26, whereby, the second end of the drive post 10 is received in the vertical compartment 27 when the drive post 10 is rotated about the pivot axle 26.

Figure 4:
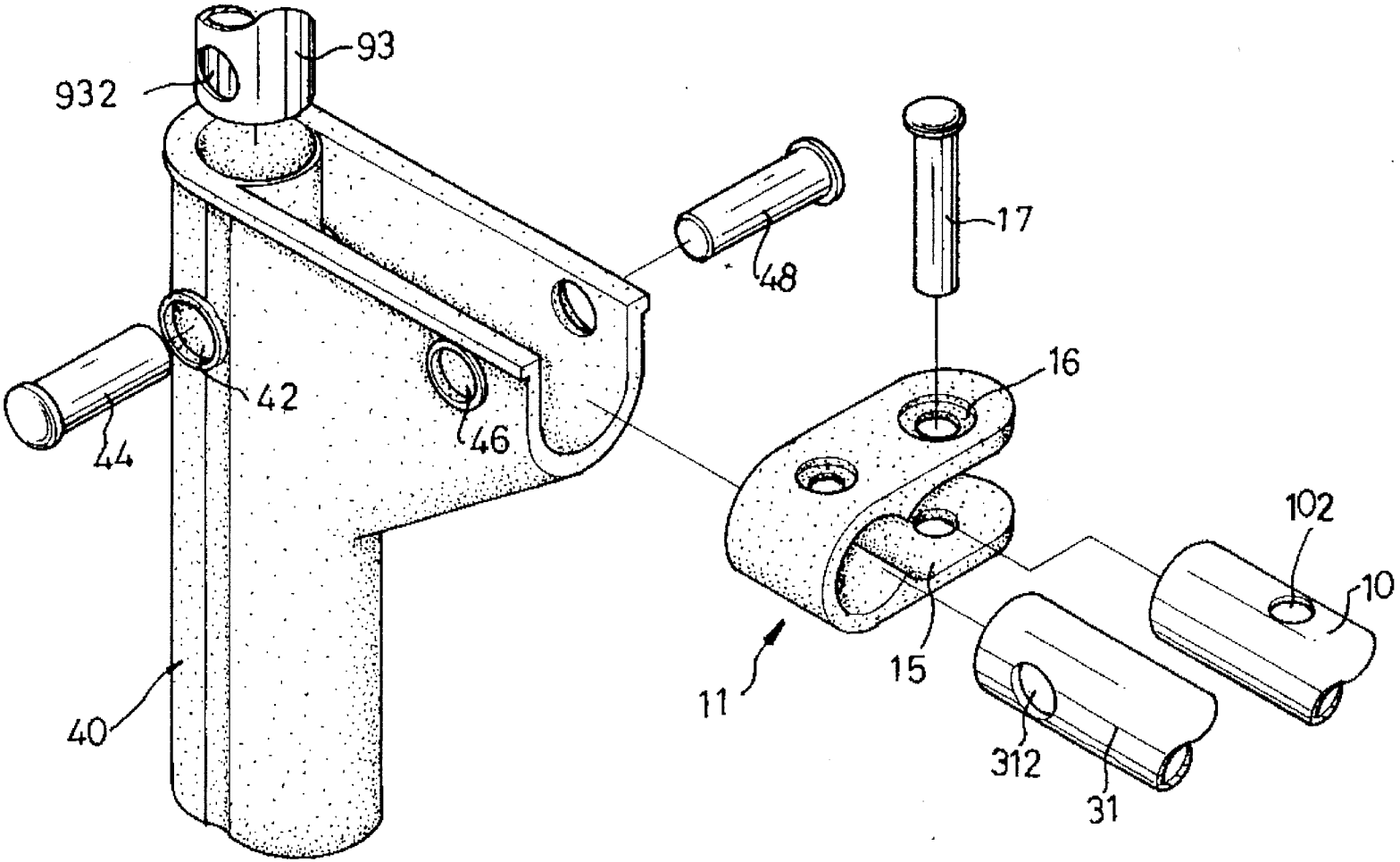
FIG. 4 is an exploded perspective view showing how a fastener member engages with a drive post and a linking rod.

Referring to FIG. 4, each of the fastener members 11 defines a recess 15 therein having an opening facing towards the base portion 20, the first end of the linking rod 31 extending through the recess 15 and pivotally engaged with the associated foot portions 40, a pair of aligned holes 16 vertically defined through the fastener member 11 and communicating with the recess 15, the first end of the drive post 10 being received in the recess 15 and defining a vertical bore 102 therethrough which communicates with the pair of holes 16, a pivot axle 17 extending through the pair of holes 16 and the vertical bore 102 such that the first end of the drive poet 10 is pivotally engaged with the fastener member 11 at the pivot axle 17. Preferably, a pivot axle 48 extends through holes 46 transversely defined in the foot portion 40 and through a bore 312 transversely defined in the first end of the linking rod 31 such that the linking rod 31 is pivoted to the foot portion 40. In addition, a pin 44 extends through bores 42 transversely defined in the foot portion 40 and through a hole 932 transversely defined in the bottom end of the vertical stands 93 so as to fix the foot portion 40 to the bottom end of the vertical stand 93.

Figure 5:
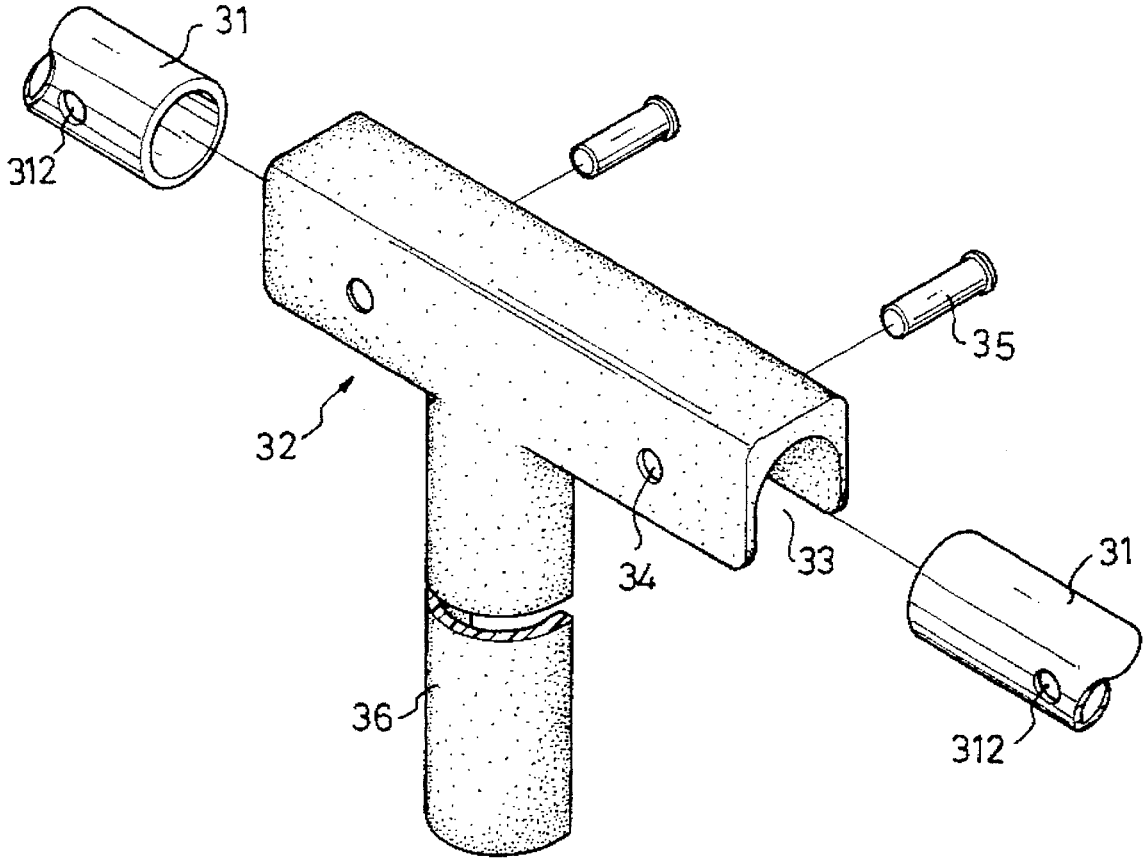
FIG. 5 is a perspective view showing how a bracket member engages with a pair of linking rods.

Referring to FIG. 5, each of the bracket members 32 has two distal ends and defines a substantially U-shaped recess 33 therethrough which has an opening facing downwardly, a pair of aligned holes 34 transversely defined through each of the distal ends of the bracket member 32, the second end of the linking rod 31 being received in the recess 33 and defining a horizontal bore 312 therethrough which communicates with the pair of holes 34 in a corresponding distal end of the bracket member 32, a pair of pivot axles 35 each extending through the pair of holes 34 and the vertical bore 312 such that the linking rod 31 is pivotally engaged with the bracket member 32 at the pivot axle 35. Preferably, a leg 36 is vertically formed on an underside of the bracket member 32 and protrudes downwardly therefrom to rest on the ground.

Figure 6:
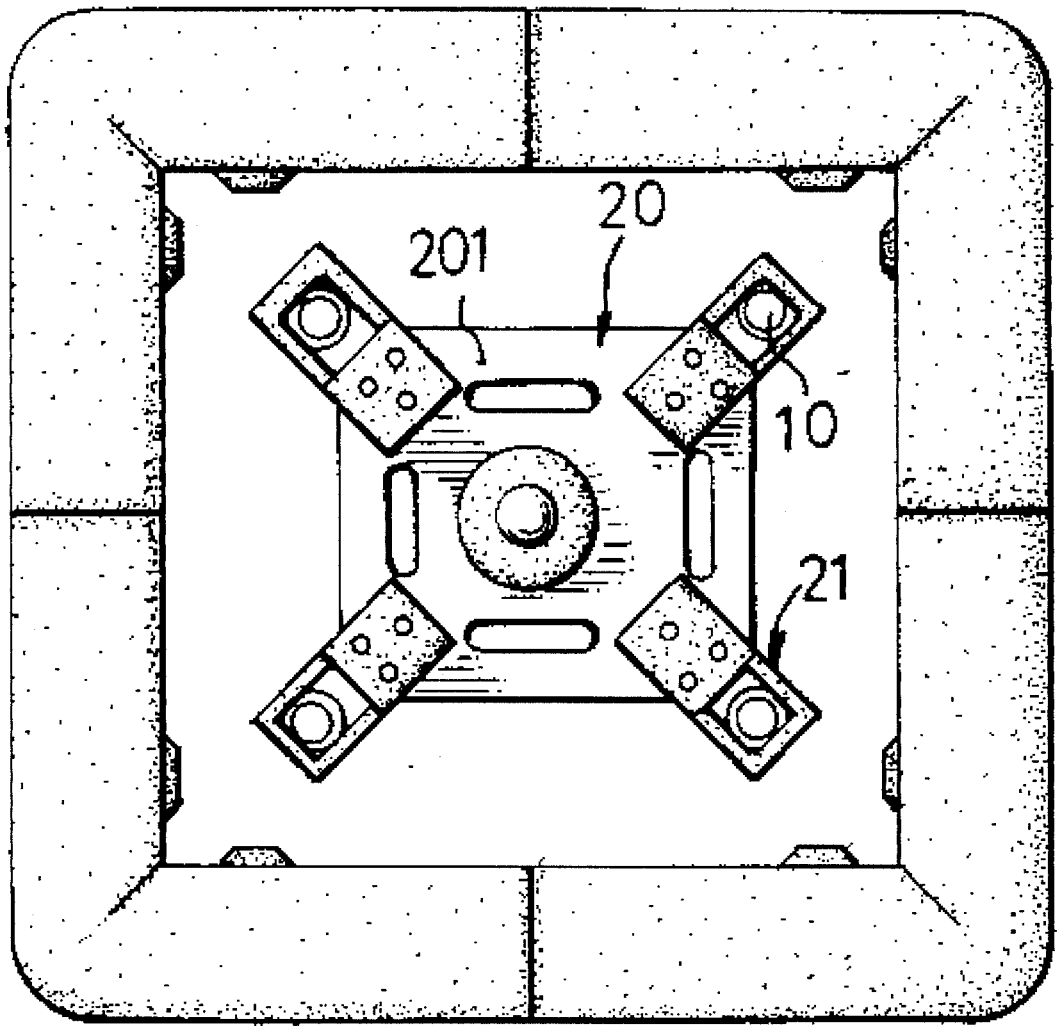
FIG. 6 is an enlarged top plan view showing the playpen in a folded statue.
Figure 7:
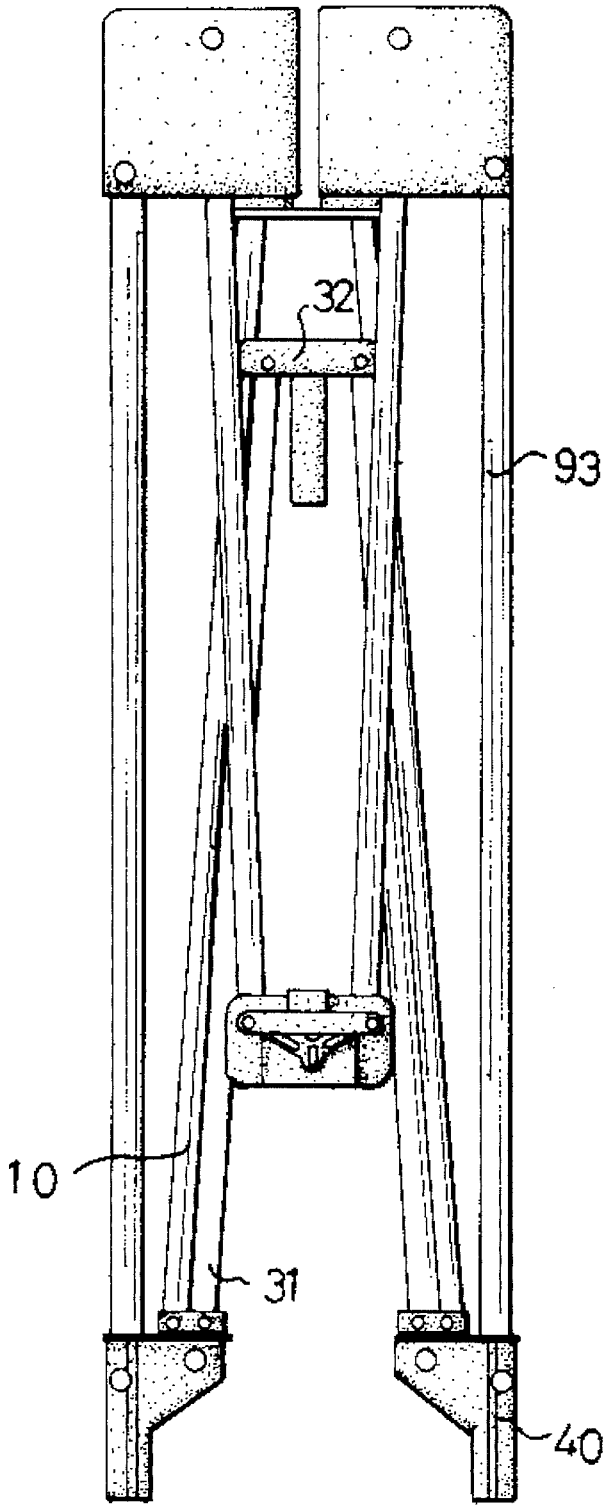
FIG. 7 is front plan view showing the playpen in a folded status.

In operation, when a user desires to fold the base portion 20 of the playpen, the user may pull the resilient strip 91 upwardly to drive the base portion 20 upwardly, whereby, each of the drive posts 10 is able to pivot relative the base portion 20 about the pivot axle 26 on the block member 21, while each of the linking rods 31 is able to pivot relative to the bracket member 32 about the pivot axle 35 and is able to pivot relative to the associated foot portion 40 about the pivot axle 46 such that the four vertical stands 93 are driven by the drive posts 10 to displace in parallel towards the base portion 20 so as to fold the playpen. FIGS. 6 and 7 show the playpen in a folded status. Conversely, when expanding, the user just needs to push the base portion 20 downwardly to displace the four vertical stands 93 in parallel outwardly by the drive posts 10, thereby expanding the base portion of the playpen.

It should be clear to those skilled in the art that further embodiments of the present invention may be made without departing from the teachings of the present invention.

I claim:

1. A device for folding and expanding a base portion of a playpen, said playpen comprising four vertical stands and a base portion mounted between said four vertical stands, four foot portions each fixedly mounted on a bottom end of a corresponding one of said four vertical stands, four drive posts each having a first end which extends to a corresponding one of said four foot portions and having a bore vertically defined therethrough, each having a second end pivotally connected to said base portion, and a flexible casing enclosed around a peripheral portion defined by said four vertical stands and having an underside engaged with said base portion, said device comprising:

four block members each fixedly mounted on an upperside of said base portion and each pivotally engaged with the second end of a corresponding one of said four drive posts;

two transmission assemblies each mounted between two of said four drive posts and located opposite to each other, each of said two transmission assemblies comprising:

a bracket member mounted in a mediate portion of said transmission assembly; and a pair of linking rods each having a first end pivotally engaged with a corresponding one of said foot portions and each having a second end pivotally engaged with said bracket member; and four fastener members each mounted on the first end of a corresponding one of said two linking rods of each of said two transmission assemblies and each pivotally engaged with the first end of a corresponding one of said four drive posts, said four fastener members each having a recess laterally defined therein for receiving the first end of an associated linking rod and the first end of an associated drive post therein, and each having two aligning holes vertically defined therein and aligning with said bore of said corresponding drive post, found pivot axles each extending through said two aligning holes of an associated fastener member and said bore of an associated drive post such that the first end of each of said four drive posts is pivotally engaged with an associated fastener member at an associated pivot axle.

2. The device in accordance with claim 1, wherein each of said two bracket members has two distal ends each having a hole transversely defined therethrough and having a substantially inverted U-shaped recess defined therethrough, the second end of each of said four linking rods being received in an associated recess and having a horizontal bore defined therethrough which aligns with an associated hole, four pivot axles each extending through an associated hole and an associated horizontal bore such that the second end of each of said four linking rods is pivotally engaged with the corresponding distal end of an associated bracket member at an associated pivot axle.

* * * * *